United States Patent [19]

Minko

[11] 3,974,736

[45] Aug. 17, 1976

[54] CARTRIDGE SHELL RELOADING TOOL

[76] Inventor: Anthony S. Minko, 18281 Oak, East Detroit, Mich. 48021

[22] Filed: Aug. 12, 1974

[21] Appl. No.: 496,585

[52] U.S. Cl. ..... 86/23; 86/36

[51] Int. Cl.[2] ..... F42B 33/02

[58] Field of Search ..... 86/23, 24, 25, 26, 27, 86/28, 29, 30, 31, 32, 33, 36, 37, 38, 39, 40, 41, 43; 81/3.05

[56] References Cited

UNITED STATES PATENTS

| | | | |
|---|---|---|---|
| 2,133,198 | 10/1938 | Jayne | 86/37 |
| 2,345,552 | 4/1944 | Ballou | 86/30 |
| 2,571,272 | 10/1951 | Martin | 86/43 |
| 2,680,988 | 6/1954 | Watson | 86/36 |
| 2,960,903 | 11/1960 | Scott | 86/23 |
| 3,196,736 | 7/1965 | Pace | 86/25 |

FOREIGN PATENTS OR APPLICATIONS

| | | | |
|---|---|---|---|
| 1,119,943 | 6/1956 | France | 86/36 |
| 10,610 | 8/1909 | France | 86/37 |

*Primary Examiner*—Harold Tudor
*Attorney, Agent, or Firm*—Basile and Weintraub

[57] ABSTRACT

A cartridge shell reloading tool for resizing empty cartridge shells and ejecting them from the reloading tool. The tool comprises a housing having a longitudinal bore threaded at one end to receive a resizing die which, in turn, receives the cartridge shell. The other end of the longitudinal bore of the tool housing slidably supports a spindle having one end which is received within the cartridge shell and engages the base of the shell such that the force of a coil spring carried within the housing bore and acting against an enlarged portion of the spindle ejects the shell from within the die bore after the shell has been properly shaped.

The upper end of the reloading tool has a threaded member extendable into the housing bore for selected mechanical abutment with the spindle to aid the coil spring in ejecting the shell from the sizing bore of the die in the event the shell is jammed therewithin.

3 Claims, 3 Drawing Figures

CARTRIDGE SHELL RELOADING TOOL

BACKGROUND OF THE INVENTION

1. Field of the Invention

The present invention relates to the reloading of cartridge shells for rifles and pistols and, in particular, the present invention relates to a new and improved reloading tool having means for ejecting the cartridge shell from within the reloading tool die.

2. Background of the Invention

Heretofore, numerous devices and tools have been fabricated for the purpose of resizing cartridge shells and examples of the apparatus for achieving this purpose are disclosed in U.S. Pat. Nos. 2,133,198, 2,571,272 and 3,196,736. The prior art structures generally disclosed a shell resizing apparatus that comprises a neck and body resizer and bullet seater which is adapted for use in resizing and centering the neck of the shell prior to the forcing of a bullet therein. Experience has shown that the reduced neck and/or body portion of a shell loses its proper size upon being used and, in addition, the reduced neck portion becomes distorted out of center relative to the remaining enlarged lower portion of the cartridge shell.

Cartridge shells of the aforementioned type are generally provided with radially extending flanges at the lower ends which may be inserted into an anvil type retainer mounted on the reloading tool such that the neck of the shell may be inserted into a resizing die, resized and withdrawn from the die by means of the anvil grasping the end of the shell. During such normal resizing of the cartridge shells, the shell may become jammed within the bore of the resizing die and, upon the application of a downward directed force by means of the tool against the flanges on the head of the cartridge shell, the flanges may be severely damaged to the extent that the cartridge is not reusable.

It would therefore be desirable to provide a reloading tool which is provided with means for ejecting the shell from the resizing die without the need for exerting any substantial force on the head of the cartridge shell. The inventor of the present invention has no knowledge of such a reloading tool.

SUMMARY OF THE INVENTION

The present invention, which will be described subsequently in greater detail, comprises a reloading tool having a resizing die adapted to receive the neck portion of a cartridge shell for the purposes of resizing the shell and means for ejecting the resized shell from within the resizing die.

It is therefore an object of the present invention to provide a new and improved cartridge shell reloading device.

It is still a further object of the present invention to provide a reloading tool having means for effectively ejecting a resized cartridge shell from within a resizing die without causing any damage to the shell.

It is still a further object of the present invention to provide a reloading tool which will provide the aforementioned results and which will not increase the cost of manufacturing such reloading tools.

Other objects, advantages, and applications of the present invention will become apparent to those skilled in the art of reloading tools when the accompanying description of one example of the best mode contemplated for practicing the invention is read in conjunction with the accompanying drawings.

BRIEF DESCRIPTION OF THE DRAWING

The description herein makes reference to the accompanying drawing wherein like reference numerals refer to like parts throughout the several view and, in which.

DESCRIPTION OF THE PREFERRED EMBODIMENT

Figure 1:
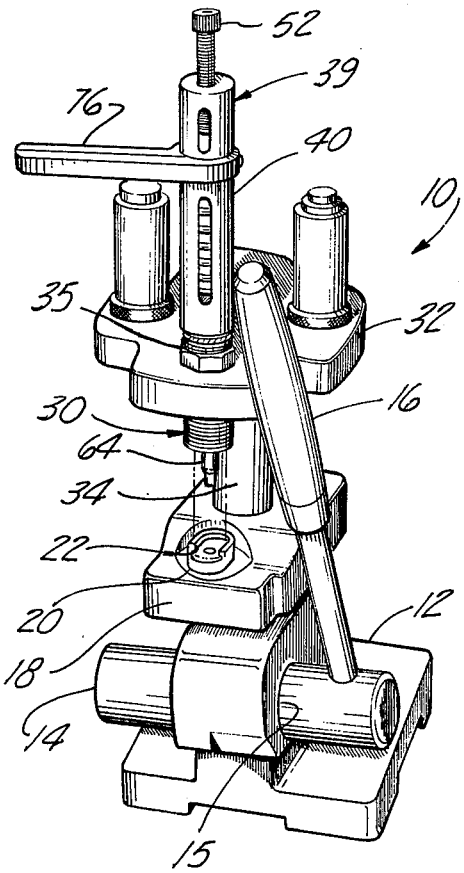
FIG. 1 is a prespective view of a reloading press having a reloading tool mounted thereon, which tool is constructed in accordance with the principles of the present invention.
Figure 2:
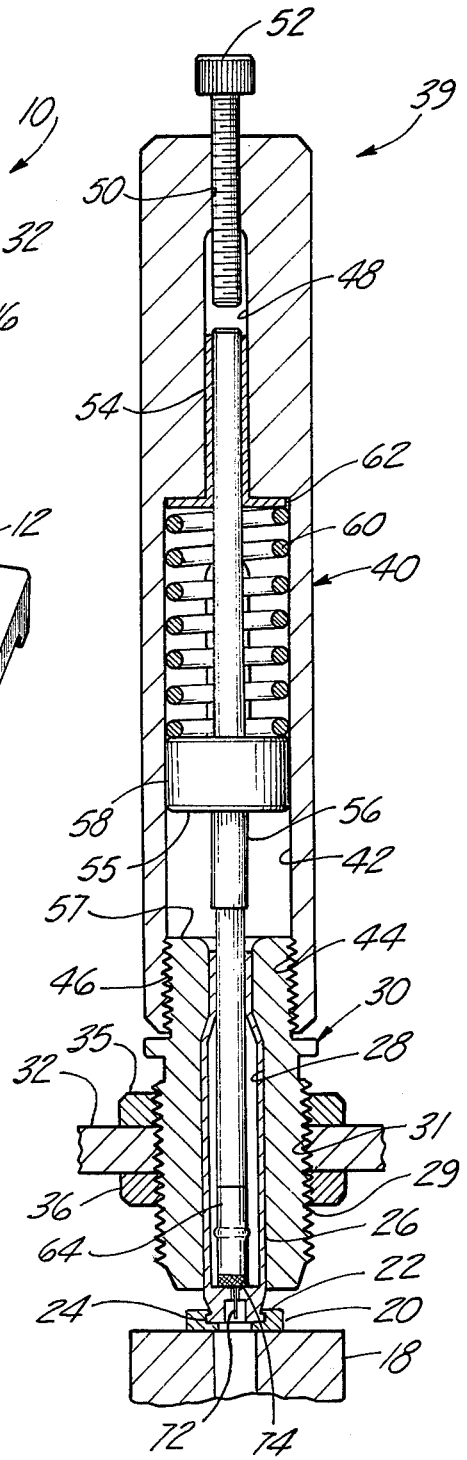
FIG. 2 is a fragmentary cross-sectional view through the reloading press illustrated in FIG. 1 showing, in greater detail, the reloading tool carried by the reloading press.

Referring now to the drawings and, in particular, to FIG. 1 wherein there is illustrated a reloading press 10 comprising a base 12 having a bore 15 through which is mounted a shaft 14 adapted to be rotated by means of a hand actuated lever 16. The shaft 14 is connected by any suitable mechanical means to a vertically movable plate 18 on which is mounted an anvil 20 having a rim 22 provided with flanges. The flanges on the rim 22 of the anvil 20 are adapted to receive the end flanges 24 (FIG. 2), formed at the butt end of a conventional cartridge shell 26, such as a rifle or pistol shell. The plate 18 is vertically movable such that the shell 26 may be raised into the longitudinal bore 28 of a full length reloading die 30 which is conventional in its construction and purpose in that the reloading die 30 functions to properly shape the outer periphery of the cartridge shell 26 such that the same may be placed into proper shape for reloading and refiring. The reloading die 30 has an outer peripherial surface that is threaded at 29 such that the die 30 may be threaded into a mating sized bore 31 formed in an upper plate 32 carried at the upper end of a mounting post 34 on which the plate 18 is vertically movable. As can be seen in FIGS. 1 and 2, the reloading tool 12 is further secured to the upper support plate 32 by means of retainer nuts 35 and 36, respectively, located above and below the plate 32 and which are threaded into a tight engagement with the upper and lower surfaces of the upper support plate 32.

The reloading die forms a portion of a reloading tool 39 which further comprises a housing 40 having a longitudinal bore 42, having a threaded section 44 at the lower end for receiving a threaded end portion 46 formed at the upper end of the reloading die 30. The housing bore 42 terminates at its upper end in a reduced diametered bore 48 which, in turn, opens to the upper end of the housing 40. The upper most portion of the bore 48 is threaded at 50 to receive a threaded member 52, the purpose of which will be explained in greater detail hereinafter.

Figure 3:
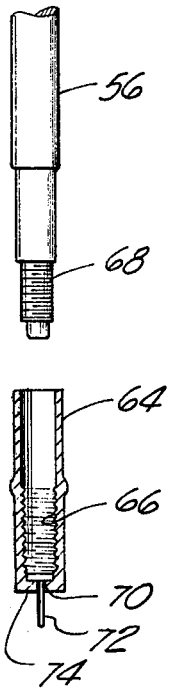
FIG. 3 is a fragmentary, partially exploded, cross-sectional view of the lower portion of the spindle utilized in the reloading tool illustrated in FIGS. 1 and 2 of the drawing.

The end of the bore 48 communicating with the enlarged bore 42 provides a means for mounting a bushing 54 which slidably supports one end of a spindle 56, the other end of which extends downwardly through the resizing bore 28 of the reloading die 30. Intermediate the opposite ends of the spindle 56, an enlarged section 58 is provided for sliding engagement with the wall of the longitudinal bore 42. The enlarged section 58 centers the lower end of the spindle 56, such that the same is movable in and out of the reloading die bore 28 in a manner to be described, while at the same time the upper surface of the enlarged section 58 provides a seat for a coil spring 60. The other end of the coil spring 60 abuts a shoulder 62 formed at the inner end of the longitudinal bore 42. It can thus be seen that while the spindle 56 is slidably supported by the longitudinal bore 42 and the bushing 54, the coil spring 60 will bias the spindle 56 downwardly such that the lower surface 55 of the enlarged section 58 of the spindle 56 will abut and come to rest in a normal position in abutment with the upper surface 57 of the reloading die 30. As can best be seen in FIG. 3, the lower end of the spindle has a cap portion 64 which is provided with an internal threaded bore 66 that engages a threaded surface 68 formed on the lower tapered end of the spindle 56 such that the cap 64 may be selectively removed and replaced on the end of the spindle 56, as desired. The lower base of the cap 64 has an aperture 70 through which a depriming pin 72 is insertable. It can be seen that when the cap 64 engages the threaded section 68 of the tapered end of the spindle 56, the end of the spindle 56 will abut the top surface of the depriming pin 72 to maintain the same in a proper position.

Referring again to FIG. 2, it can be seen that when a cartridge shell 26 is in position, that is the anvil or shell holder head 20 is grasping the flanges 24 of the shell base and the plate 18 is raised by means of the hand actuated hand lever 16 to insert the neck portion of the cartridge shell 26 into the resizing bore of the reloading die 30 such that the shell 26 is reshaped in the conventional manner, the lower most end 74 of the cap on the spindle 56 will abut the interior base of the shell (FIG. 2). At the same time, the depriming pin 72 passes through the primer bore of the shell 26 and ejects the spent primer from the cartridge shell 26. It can also be seen that as the base 18 is raised relative to the upper support plate 32, the shell 26 will be driven into the sizing bore 28 and the base portion of the shell 26 will continue to engage the lower end 74 of the spindle 56 moving the spindle 56 upwardly against the bias of the spring 60, as shown in FIG. 2, until the shell 26 has been inserted within the die 30 its maximum distance of penetration and is resized in the conventional manner.

Normally in such reloading presses, ejection of the shell 26 is accomplished by means of lowering the plate 18 such that the flanges on the rim 22 of the anvil 20 that are engaging the shell base head flanges 24 force the shell out. If the shell 26 is in any manner jammed within the resizing die 30, it is possible that the shell flanges 24 at the base thereof will be severely damaged, if not completely severed from the shell.

The aforementioned difficulty with the prior art structure is completely overcome by the present invention whereby the coil spring 60 exerts a downward force against the spindle 56 which, in turn, abuts the base of the shell 24 such that as the handle lever 16 is rotated to cause a lowering of the plate 18, the force of the spring 60 against the spindle 56 will eject the shell 26 from within the reloading die bore 28.

In the event that the shell 26 is so jammed into the resizing bore 28 that the force of the spring 60 is not sufficient to overcome the jammed shell and eject the same, then the threaded member 52, which may be provided with a suitable slot at the top thereof, may be rotated until the lower end of the member 52 engages the upper end of the spindle 56 to exert a direct mechanical force on the spindle 56 and lower the same so as to forcefully eject the shell 26 by means of the abutment of the spindle 56 with the base of the shell 26. In either circumstance virtually no force is exerted on the flanges 24 at the head of the shell, and thus, the possibility of damaging the shell flanges 24 is minimized, if not completely eliminated.

As it can best be seen in FIG. 1, the reloading tool 12 is provided with a handle 76 which facilitates the gripping of the press 10 to further stabilize the same during operation of the reloading tool 12.

It should be understood by those skilled in the art that various forms of the threaded member 52 may be utilized; for example, a ratchet type of mechanism may be utilized in conjunction with the threaded member 52 to facilitate the easy threading of the member 52 into the threaded bore 50.

It should also be recognized that the bushing 54 in the present embodiment is disposed within the bore 48 such that the bottom flange of the bushing 54 abuts the shoulder 62 of the housing bore 42 which limits the upward movement of the bushing 54 within the reduced diametered bore 48. At the same time, the biasing force of the spring 60 acting against the flanges of the bushing 54 restrains the bushing 54 from downward movement.

It can thus be seen that the present invention has provided a new and improved reloading tool for resizing cartridge shells and one which will perform in a manner comparable to prior art devices with respect to the reshaping of the cartridge shell, yet, one which has a simple and effective means of ejecting the shell from the reloading tool without the possibility of damage to the head of the shell.

Although only one example of the present invention has been disclosed, it should be understood by those skilled in the art that other forms may be had, all coming within the spirit of the invention and the scope of the appended claims.

What is claimed is as follows:

1. A reloading tool for resizing empty rifle and pistol metal cartridge shells of the type having end flanges formed at the butt ends thereof, said tool comprising a housing having a longitudinal bore; a die carried at one end of said housing bore, the other end of said housing bore having a threaded portion, said die having a longitudinal bore axially aligned with said housing bore; an anvil having means for slidably receiving the end flanges of said cartridge shell for holding said shell in axial alignment with said die bore; means moving said anvil relative to said die bore in a first direction such that one end of said die bore receives said cartridge shell to resize the same and in a second direction to forcibly withdraw said shell from said die bore, the other end of said die longitudinal bore opening into said housing bore; a spindle slidably mounted in said housing bore and having one end extending through said die bore for abutting engagement with the interior of the butt end of said shell; a coiled spring carried within said housing bore, said coiled spring having one end abutting a portion of said housing while the other end of said coiled spring abuts a portion of said spindle for urging said spindle into said abutting engagement with said shell butt end applying an additional force against said shell to aid said anvil in forcibly withdrawing said shell out of said die bore when said anvil is moved in said second direction; and a threaded member in said threaded portion of said housing longitudinal bore and adapted to engage the other end of said spindle for exerting a mechanical force on said spindle to eject said shell from said die bore.

2. The reloading tool defined in claim 1 wherein said housing longitudinal bore has an enlarged diametered section defining a shoulder; said spindle has an enlarged portion which is slidably disposed in the enlarged section of said housing longitudinal bore; said spring being disposed in said enlarged section of said housing bore between said shoulder and said enlarged portion of said spindle for urging said spindle toward said anvil.

3. The reloading tool defined in claim 2 wherein said enlarged portion of said housing bore communicates with a reduced section at the other end of said longitudinal bore, said reduced section having a bushing disposed therein to slidably support said spindle.

* * * * *